United States Patent [19]

Glasser et al.

[11] Patent Number: 4,880,333

[45] Date of Patent: Nov. 14, 1989

[54] SUBTERRANEAN FLUID FILTERING AND DRAINAGE SYSTEM

[76] Inventors: Joseph Glasser, 15 Westwood Rd., Storrs, Conn. 06263; Ursula E. Laak, 149 Brown Rd., Storrs, Conn. 06268

[21] Appl. No.: 223,207

[22] Filed: Jul. 22, 1988

[51] Int. Cl.[4] ..... E02B 11/00

[52] U.S. Cl. ..... 405/43; 405/45; 405/36; 52/169.14; 52/169.5; 210/490; 210/492; 210/498; 210/170

[58] Field of Search ..... 405/36, 43, 44, 45, 405/46, 47, 48, 49; 52/169.14, 169.5; 210/490, 492, 498, 170

[56] References Cited

U.S. PATENT DOCUMENTS

| | | | |
|---|---|---|---|
| 1,780,791 | 11/1930 | Lenderink | 405/43 X |
| 2,795,542 | 6/1957 | Horne et al. | 405/36 X |
| 4,490,072 | 12/1984 | Glasser | 405/45 |
| 4,574,541 | 3/1986 | Raidt et al. | 405/45 X |
| 4,639,165 | 1/1986 | Flecknoe-Brown | 405/45 |
| 4,745,716 | 5/1988 | Kuypers | 405/43 X |

FOREIGN PATENT DOCUMENTS

| | | | |
|---|---|---|---|
| 66217 | 4/1982 | Japan | 405/43 |
| 199920 | 11/1983 | Japan | 405/43 |
| 134416 | 6/1986 | Japan | 405/36 |

*Primary Examiner*—Dennis L. Taylor
*Assistant Examiner*—J. Russell McBee
*Attorney, Agent, or Firm*—McCormick, Paulding & Huber

[57] ABSTRACT

A subterranean drainage and fluid filtration system includes an inlet conduit defined by fluid filtering fabric encasing a fluid pervious panel with raised lands and depressions to define passageways for the fluid. The fluid flows downwardly into a filtration system comprising the serpentine wrapped filter fabric in which core sheets and spacers are provided. These core sheets and spacers may be identical to one another and each includes raised lands so as to achieve flow of fluid downwardly and horizontally through the fluid filter.

15 Claims, 3 Drawing Sheets

10
12b
12e
3
W
16a
16
12
12c
10a
14
12d
12a
18
26
22a
20
24
30
22
H

16

SUBTERRANEAN FLUID FILTERING AND DRAINAGE SYSTEM

This invention relates generally to drainage systems for filtering and distributing fluids such as leachate, and deals more particularly with a system capable of absorbing in the subterranean subsoil environment fluid leachate from a conventional septic tank on the like.

More specifically, the invention involves an improved in-drain structure with a horizontally extending stack of vertically oriented core sheets wrapped with a serpentine folded fluid pervious fabric such that areas or regions of the fabric are provided adjacent the opposed faces of the core sheets. Each core sheet is impervious to the fluid and has non-planar opposed faces defining raised lands and surrounding valleys that define passageways for the fluid to allow the fluid to drain downwardly adjacent these core sheet faces into the subsoil. In this stack of core sheet some fluid will pass through the fabric adjacent the lower marginal edge of an associated core sheet, while additional fluid will be passed around the ends of the core sheets as a result of the serpentine wrapped pervious fabric surrounding said sheets to be passed through the fabric adjacent the lower marginal edges of other core sheets.

In the drainage system according to the present invention fluid to be filtered is provided to these stacked serpentine fabric wrapped core sheets, by fluid conduit means provided immediately above the stack. A layer of filter fabric is wrapped around a fluid pervious plastic panel oriented in a generally horizontal plane and also located generally perpendicular to the stack of fluid impervious core sheets. The transverse dimension of the plastic panel corresponds closely to the width of the stack itself and hence to the width of the individual core sheets. This panel, like the core sheets, has raised lands on both opposed faces.

In the preferred embodiment the serpentine shaped fabric is wrapped around the fluid impervious parallel core sheets to form U-shaped pockets around each core sheet so that the fluid from the conduit means flows downwardly into these U-shaped pockets and along the faces of these core sheets.

The core sheets are preferably separated by spacers that may themselves comprise core sheets, and each spacer is preferably wrapped with an inverted U-shaped fabric segment that includes a portion above the spacer to direct fluid from the conduit means into the above described pockets. This geometry provides two fabric layers adjacent each face of each core sheet and also adjacent each face of the intermediate spacer material.

It is a feature of the present invention that as the fluid filter material becomes clogged by leachate from a septic system that the fluid will be led further downstream in the serpentine wrapped fluid fabric to an area where the fluid filter has not been clogged in order to achieve a self regulating mode of operation for the system not possible with prior art systems of this general type.

DETAILED DESCRIPTION

Figure 1:
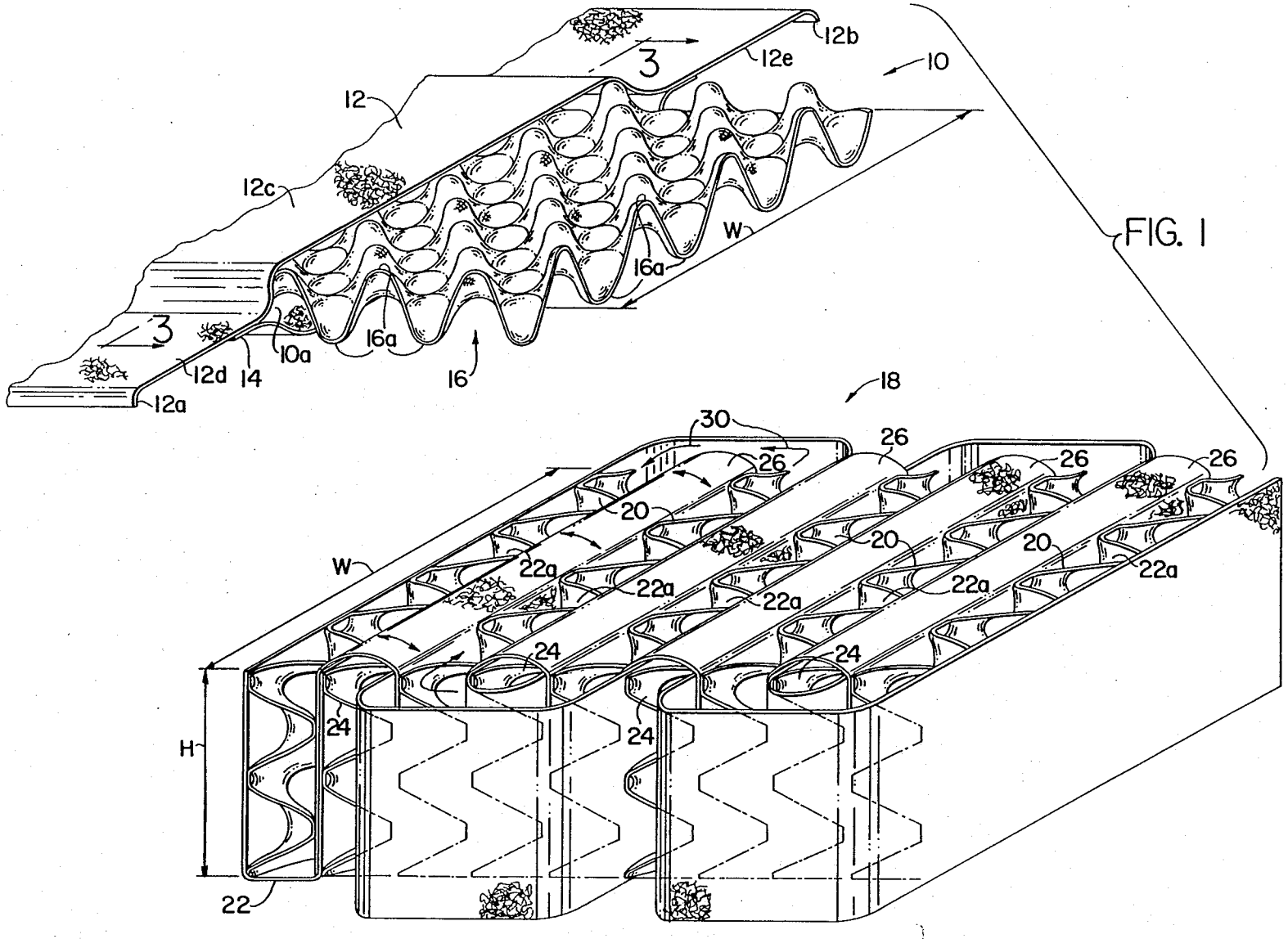
FIG. 1 is a perspective view partly in section illustrating in exploded relationship the conduit and filtration components of a drainage system constructed in accordance with the present invention.

Turning now to the drawings in greater detail, FIG. 1 illustrates in exploded relationship the various components of a subterranean drainage system for fluid filtration. This system would normally be provided approximately six inches below the surface and adapted to receive the fluid such as septic leachate from a septic tank or the like. As shown the system comprises a fluid inlet conduit means 10 oriented generally horizontally to provide an elongated subterranean cavity 10*a* for receiving the fluid to be filtered. This cavity is defined by at least one and preferably two layers of filter fabric 12 and 14 the larger of which extends beyond the cavity 10*a* and includes longitudinally extending marginal edges 12*a* and 12*b*. The smaller of the two layers of fabric 14 is provided beneath the first layer 12 and cooperates with a raised center portion 12*c* to define the cavity 10*a* as shown. This smaller fabric layer 14 is preferably stitched or otherwise secured to the wing portions 12*d* and 12*e* of the at least one layer of filter fabric. The filtered fabric comprises a non-woven synthetic material that is previous to the fluid being handled (such as leachate from a residential or commercial septic system).

Figure 2:
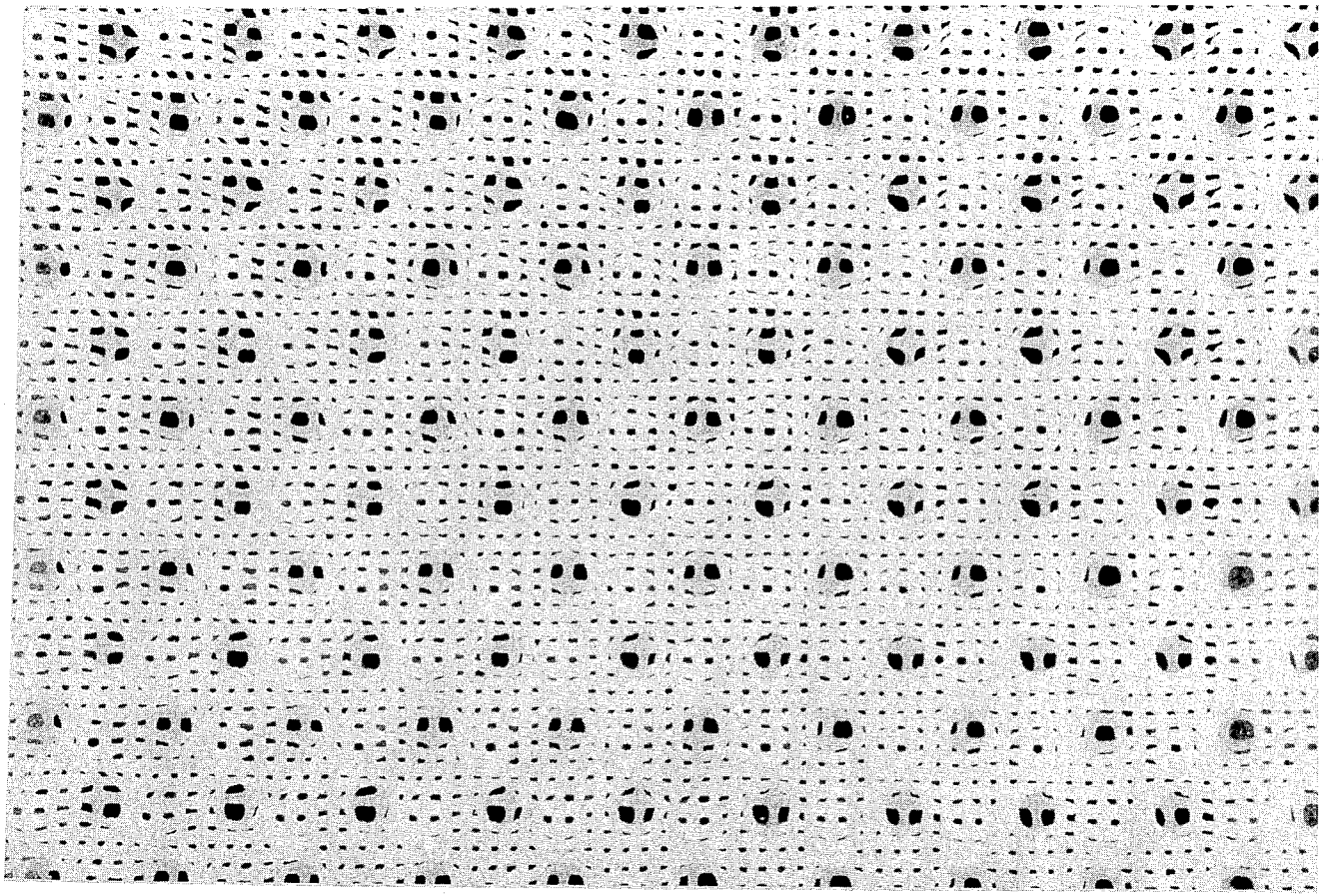
FIG. 2 is a plan view of the fluid pervious plastic panel or net provided in the conduit portion of the system in FIG. 1.
Figure 3:
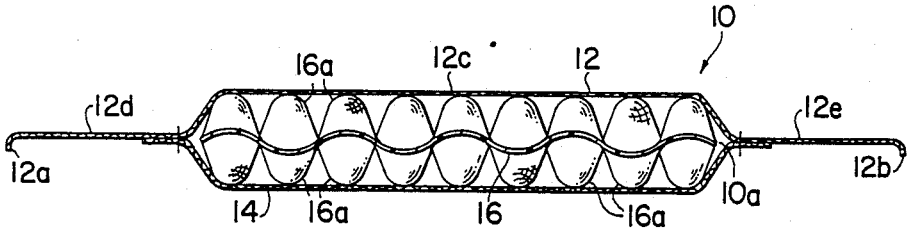
FIG. 3 is a sectional view taken generally on the line 3—3 of FIG. 1.

Since the above described cavity 10*a* defined by the filter fabric layers 12 and 14 will be provided below the surface of the ground (preferably at least six inches below such surface) means is provided for maintaining the shape of this cavity 10*a*. The cavity 10*a* must be of such a size as to handle the flow of water or fluid or leachate. Preferably the means for so maintaining the right size for cavity 10*a* comprises a generally horizontally extending fluid pervious plastic panel of net like but nevertheless rigid consistency as illustrated in FIG. 2. This panel indicated generally at 16 in FIG. 1 has a width W corresponding at least approximately to the width of the cavity 10*a* and has a longitudinal length that preferably corresponds to the length of the filter fabric layers 12 and 14. However, smaller segments of pervious plastic panel material might be adapted for use in overlying relationship one on top of another if such a construction is more suitable to a particular installation.

In further accordance with the present invention fluid filtering means is provided below the fluid inlet conduit means described above. FIG. 1 illustrates such a fluid filtering means generally at 18. In its presently preferred form the fluid filtering means comprises a plurality of fluid impervious core sheets 20 which sheets are oriented parallel to one another and have non-planar opposed faces arranged in spaced relationship to one another so as to form a generally rectangular elongated stack of width W and height H. The width W corresponds at least approximately to the width W of the pervious panel 16 of the fluid inlet conduit means. The height H is preferably at least equal to one half the dimension W.

These impervious core sheets may be similar to the material described in my prior U.S. Pat. No. 4,490,072 in that the core sheet material described therein provides a convenient form for the stack of core sheets that comprise a portion of the fluid filtering means of the present invention. More particularly, each core sheet has raised lands on its opposed faces which lands are formed from an initially flat sheet of relatively stiff polystyrene by passing the styrene sheet between opposed rollers or mandrels that have radially projecting pins to engage the polystyrene and to upset the polystyrene to form raised lands and surrounding valleys so as to conveniently define passageways on each face of the core sheet to facilitate the flow of water downwardly and also horizontally within the fluid filtering means disclosed in this application.

Figure 4:
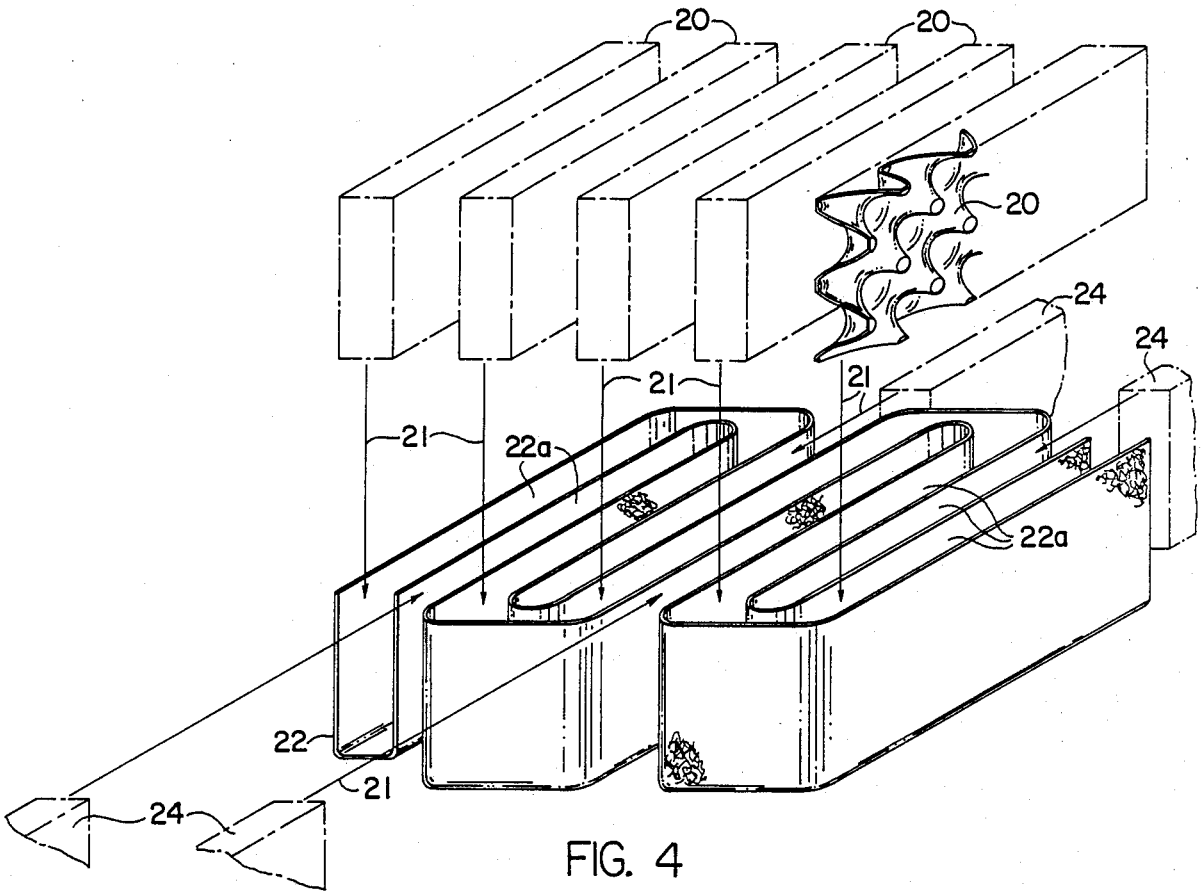
FIG. 4 shows in exploded relationship the components of the filtration stack of core sheets and spacers together with the U-folded serpentine fabric material with which these elements are assembled.

The fluid filtering means of the present invention further includes a fluid pervious filter fabric similar in consistency to the fabric used in the fluid inlet conduit means 10 but which fluid fabric of the filtering means is preferably first formed into a generally U-shape as suggested in FIG. 4 at 22 and then bent back upon itself in a serpentine fashion so as to provide pockets 22*a* for receiving the individual core sheets 20 referred to above. These core sheets are indicated schematically in FIG. 4 and arrows 21 illustrtate the manner in which such core sheets 20 can be inserted in the pockets 22*a* defined by the serpentine shaped filter fabric itself.

In order to provide a space between the adjacent core sheets 20 spacers 24 are inserted between the reversely bent filter fabric segment or regions associated with the opposed faces of the core sheets 20. FIG. 4 illustrates this combination of components in exploded relationship and FIG. 1 illustrates the spacers 24 after they have been so inserted in the fluid filtering means 18.

In further accordance with the present invention a filter fabric segment 26 having an inverted U-shape cross sectional configuration is inserted around each spacer 24 such that the legs of the U lie adjacent the opposed faces of the core sheets 20 in the adjacent pockets 22*a* defined by the serpentine shaped filter fabric 22.

As so constructed and arranged fluid flowing through the cavity 10*a* defined by the inlet conduit means 10 will be carried along between the raised portions 16*a* of the fluid pervious pane 16 with at least some of the fluid passing through the openings defined by the netlike panel 16 downwardly and thence through the fluid filter fabric 14 into the pockets 22*a* defined by the serpentine wrapped filter fabric of the filtering means. The inverted U-shaped fabric segments 26 will tend to direct fluid into these pockets defined by the serpentine wrapped filter fabric material where some fluid will flow downwardly across the opposed faces of the core sheets 20 and some fluid will flow around the ends of the spacers as suggested by the arrow 30 to reach an adjacent pocket 22*a* and thence further downstream into another adjacent pocket depending upon the flow rate of the fluid being handled by the filtering means itself.

In accordance with the present invention the spacers 24 also comprise rectangular core sheet material so that fluid flowing through the inverted U-shaped fabric segments will be caused to flow downwardly into the subsoil below the fluid filtering means. It is a feature of the present invention that as the fluid filter material becomes clogged by leachate from a septic system that the fluid will be led further downstream in the serpentine wrapped fluid fabric to an area where the fluid filter has not been clogged in order to achieve a self regulating mode of operation for the system not possible with prior art systems of this general type.

The spacers 24 might also comprise a less porous spacer as it is an important feature of the present invention to provide a serpentine flow path for the fluid through successive pockets containing core sheets 20 which core sheets are over-wrapped with fluid filtering fabric in order to assure that fluid leaving the filtration system is in fact suitably filtered before reaching the subsoil.

I claim:

1. A subterranean drainage system for fluid filtration, said system comprising fluid conduit means oriented generally horizontally to provide an elongated subterranean cavity for receiving fluid to be filtered, said fluid conduit means including at least one layer of filter fabric provided around at least a portion of said elongated cavity and having laterally outwardly extending marginal edge portions, said fluid conduit means providing communication between said cavity and the region below said marginal edge portions, fluid filtering means below said inlet conduit means and including a plurality of fluid impervious core sheets, said sheets oriented parallel to one another and having non-planar opposed faces arranged in spaced relation to one another to form a generally rectangular elongated stack of width (W) and height (H), fluid pervious filter fabric wrapped in serpentine fashion around said non-planar faces of said core sheets to provide at least one layer of fabric of width (W) and height (H) adjacent said non-planar faces of said core sheets.

2. The combination of claim 1 wherein said filter fabric has a U-shaped cross sectional configuration such that major portions of the legs of the U are adjacent said non-planar faces of said core sheets and such that the base of the U is adjacent a lower marginal edge of said core sheets.

3. The combination of claim 2 further characterized by spacers between said filter fabric layers adjacent said core sheets.

4. The combination of claim 3 wherein said spacers comprise non-planar core sheets, and filter fabric segments for said spacers, each such filter fabric segment having an inverted U-shaped cross sectional configuration such that the legs of the U are adjacent the opposed faces of said core sheets.

5. The combination of claim 4 wherein each said inverted U-shaped filter fabric segment also has a base portion adjacent a marginal edge of said spacer, said inverted U-shaped filter fabric segment having its legs adjacent said major portions of said legs of said U-shaped filter fabric whereby the fluid entering into said U-shaped serpentine wrapped fabric flows from adjacent the faces of one core sheet into the regions adjacent the faces of another core sheet.

6. The combination of claim 5 wherein said non-planar core sheets comprise formed plastic panels having raised lands and surrounding valleys on said opposed faces to provide passageways for the fluid moving in the regions between said core sheets and said filter fabric layers.

7. The combination of claim 6 wherein said spacers also comprise plastic panels having raised lands and surrounding valleys on opposed faces thereof.

8. The combination of claim 1 wherein said fluid inlet conduit means further comprises a fluid pervious plastic panel of elongated generally rectangular form oriented generally horizontally such that its longitudinal dimension is oriented perpendicular to the said stack width.

9. The combination of claim 8 wherein said pervious plastic panel has raised lands and surrounding valleys to definer regions above and below said pervious panel that communicates with one another inside said elongated cavity.

10. The combination of claim 9 wherein said filter fabric has a U-shaped cross sectional configuration such that major portions of the legs of the U are adjacent said non-planar faces of said core sheets and such that the base of the U is adjacent a lower marginal edge of said core sheets.

11. The combination of claim 10 further characterized by spacers between said filter fabric layers adjacent said core sheets.

12. The combination of claim 11 wherein said spacers comprise non-planar core sheets, and filter fabric segments for said spacers, each such filter fabric segment having an inverted U-shaped cross sectional configuration such that the legs of the U are adjacent the opposed faces of said core sheets.

13. The combination of claim 12 wherein each said U-shaped filter fabric segment also has a base portion adjacent a marginal edge of said spacer, said U-shaped filter fabric segment having its adjacent said major portions of said legs of said U-shaped filter fabric whereby the fluid entering into said U-shaped serpentine wrapped fabric flows from adjacent the faces of one core sheet into the regions adjacent the faces of another core sheet.

14. The combination of claim 13 wherein said non-planar core sheets comprise formed plastic panels having raised lands and surrounding valleys on said opposed faces to provide passageways for the fluid moving in the regions between said core sheets and said serpentine wrapped fabric.

15. The combination of claim 14 wherein said spacers also comprise plastic panels having raised lands and surrounding valleys on opposed faces thereof.

* * * * *